US012752203B2

(12) United States Patent
Gordt et al.

(10) Patent No.: US 12,752,203 B2
(45) Date of Patent: Oct. 6, 2026

(54) AMUSEMENT RIDE AND METHOD FOR OPERATING AN AMUSEMENT RIDE

(71) Applicant: MACK RIDES IP GMBH & CO. KG, Waldkirch (DE)

(72) Inventors: Dennis Gordt, Sexau (DE); Tobias Haasch, Waldkirch (DE); Michael Kraus, Ehrenkirchen (DE)

(73) Assignee: MACK RIDES IP GMBH & CO. KG, Waldkirch (DE)

( * ) Notice: Subject to any disclaimer, the term of this patent is extended or adjusted under 35 U.S.C. 154(b) by 222 days.

(21) Appl. No.: 18/682,644

(22) PCT Filed: Aug. 10, 2022

(86) PCT No.: PCT/EP2022/072415
§ 371 (c)(1),
(2) Date: Feb. 9, 2024

(87) PCT Pub. No.: WO2023/017067
PCT Pub. Date: Feb. 16, 2023

(65) Prior Publication Data

US 2024/0350928 A1 Oct. 24, 2024

(30) Foreign Application Priority Data

Aug. 12, 2021 (DE) ..... 10 2021 121 045.8

(51) Int. Cl.
*A63G 31/02* (2006.01)
*A63G 21/04* (2006.01)

(52) U.S. Cl.
CPC ..... *A63G 31/02* (2013.01); *A63G 21/04* (2013.01)

(58) Field of Classification Search
CPC ..... A63G 31/02; A63G 1/24; A63G 25/00; A63G 21/04; A63G 7/00; B60R 22/00;
(Continued)

(56) References Cited

U.S. PATENT DOCUMENTS 5,403,238 A * 4/1995 Baxter ..... A63G 31/16 472/43
6,220,965 B1 * 4/2001 Hanna ..... A63G 7/00 463/52

(Continued)

FOREIGN PATENT DOCUMENTS

DE 4101712 C2 7/1991
DE 10245150 A1 4/2004

(Continued)

OTHER PUBLICATIONS

Office action issued by the German Patent Office on Apr. 28, 2022, in corresponding application.

*Primary Examiner* — Omkar A Deodhar
(74) *Attorney, Agent, or Firm* — Nath, Goldberg & Meyer; Jerald L. Meyer; Morgan D. Rosenberg

(57) ABSTRACT

An amusement ride includes at least one vehicle which is guided along a track, at least one passenger receptacle for accommodating a passenger being situated on the vehicle. A movement, position, and/or orientation of the passenger receptacle relative to the vehicle is changeable by means of at least one adjusting unit in at least one degree of freedom. A controller controls the adjusting unit. The controller is in signal communication with a memory in which movements to be performed, positions to be assumed, and/or orientations to be assumed during the ride of each passenger receptacle are stored directly or indirectly as memory content. The controller is designed to allow the positions, orientations, and/or movements to be assumed in sequence at a given point on the track during the ride. The amusement ride has means by which the passenger determines the memory content for the relevant passenger receptacle.

2 Claims, 1 Drawing Sheet

(58) Field of Classification Search
CPC .... B61K 3/02; B61K 9/08; B61B 7/00; B61L 23/04
See application file for complete search history.

(56) References Cited

U.S. PATENT DOCUMENTS

| | | | | |
|---|---|---|---|---|
| 8,491,403 | B2 * | 7/2013 | Schreibfeder | A63G 31/16 472/2 |
| 8,678,940 | B2 * | 3/2014 | Willcox | A63G 1/30 472/130 |
| 9,751,022 | B1 * | 9/2017 | Fram | B61B 3/02 |
| 11,491,409 | B2 * | 11/2022 | Beutler | A63G 31/02 |
| 2017/0246484 | A1 * | 8/2017 | Beutler | A63G 7/00 |
| 2017/0282853 | A1 * | 10/2017 | Burger | B60R 22/48 |
| 2020/0236461 | A1 * | 7/2020 | Hall | G06F 3/016 |
| 2020/0298133 | A1 * | 9/2020 | Magpuri | A63G 7/00 |
| 2020/0324212 | A1 * | 10/2020 | Sornik | A63G 27/00 |
| 2021/0016192 | A1 * | 1/2021 | Heyse | A63G 7/00 |
| 2021/0229613 | A1 * | 7/2021 | Wilcox | A63G 31/00 |

FOREIGN PATENT DOCUMENTS

| | | | |
|---|---|---|---|
| DE | 202010000403 | U1 | 9/2011 |
| DE | 102019130956 | A1 | 5/2021 |
| WO | 2019168937 | A1 | 9/2019 |

* cited by examiner

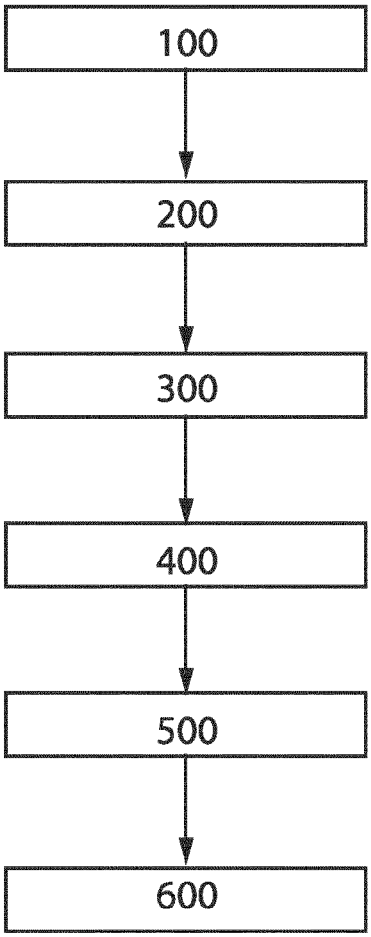
100
200
300
400
500
600

AMUSEMENT RIDE AND METHOD FOR OPERATING AN AMUSEMENT RIDE

This is a National Phase Application filed under 35 U.S.C. 371 as a national stage of PCT/EP2022/072415, filed Aug. 10, 2022, an application claiming the benefit of German Application No. 10 2021 121 045.3 filed Aug. 12, 2021, the content of each of which is hereby incorporated by reference in its entirety.

Amusement rides are popular attractions in leisure and amusement parks, fairs, and public festivals. They usually have at least one vehicle having at least one passenger receptacle, for example a seat, which is guided along a track. The appeal of riding on the amusement ride can be imparted by the course of the track, as is the case with a roller coaster, for example, and by the surroundings of the track, for example in the case of a ghost train or riding in a rail-bound vehicle through a fairytale land for children.

A measure that has already been implemented in some such amusement rides to increase the appeal of the ride is that the passenger receptacle can be positioned and/or moved relative to the vehicle by means of an adjusting unit. During the roller coaster ride or while riding on the Fairyland Express, the perspective from which the ride is experienced is changed according to a fixed pattern.

In both cases, the appeal of the ride can be further increased by allowing individual movement or positioning of the passenger receptacle relative to the seat. For example, it may seem attractive to die-hard roller coaster fans if their seat also rotates about its own axis while riding a loop or for their seat to be rotated 90° to the direction of travel during a helical path, while, on the Fairyland Express, the relative movement between the passenger receptacle and the vehicle makes it possible for a child to look at the scene of their favorite fairy tale for a particularly long time.

In addition, the next time the roller coaster rides, it should be possible for someone to sit in the same seat for whom the movement of the vehicle along the rail is so on the edge that they would like to turn their passenger receptacle around during fast portions of track so that they do not have to look into the abyss during the ride, or the favorite fairy tale of the child occupying the same seat on the next ride through the fairyland is a different one and would be visible for a longer time if the passenger receptacle were oriented differently.

It is thus immediately clear that a movement or positioning of the passenger receptacle is preferably not predetermined, but can be carried out individually. The movement or positioning of the passenger receptacle should not be predetermined by the fact of sitting or having to sit in a particular passenger receptacle of the vehicle. In practice, the allocation of passenger receptacles is usually based on the position of each passenger in the queue and cannot be selected.

According to an approach to solving this problem known from DE 20 2010 000 403 U1, each passenger receptacle is directly assigned a controllable movement device, the movement of which is controlled by the passenger using an operating device. For example, such an operating device can be a joystick, and actuating the joystick during the ride then leads to a change in the position and/or orientation of the passenger receptacle relative to the vehicle. In practice, however, it is evident that this approach is only practical for relatively slow rides and only if an adult takes control. In most cases, the stimuli and/or forces to which one is exposed while riding the amusement ride prove to be so strong that the adequate and precise use of the operating device is negatively influenced or completely prevented as a result.

The object of the invention is therefore to provide an amusement ride that enables improved customization options for the passenger position during the ride and to provide a method for operating such an amusement ride.

This object is achieved by an amusement ride having the features of claim 1 and by a method for operating such an amusement ride having the features of claim 2. The dependent claims relate to advantageous developments of the invention.

The amusement ride according to the invention comprises at least one vehicle which is guided along a track, at least one passenger receptacle for accommodating a passenger being situated on the vehicle.

The vehicle can be, for example, a train or a car which travels on rails defining the track, as is often the case with a roller coaster. But the vehicle can also be, for example, a boat which is guided through a canal system on a particular route using a towing mechanism. Another alternative mentioned as an example is gondolas or trolleys, the path of which can be predetermined by guide rails or an extension of track cables.

In most embodiments, the passenger receptacle is a seat which can be situated, for example, on the vehicle or suspended from the vehicle. For example, it can also be an arrangement on which the passenger stands during the ride, as is used in stand-up roller coasters, from which the passenger hangs or on which the passenger lies.

The movement, position, and/or orientation of each passenger receptacle relative to the vehicle can be changed or adjusted in at least one degree of freedom by means of at least one adjusting unit. The passenger receptacle can, for example, be rotatable or pivotable about one or more axes by the adjusting unit or adjusting units, but it can also be movable in one or more directions. These degrees of freedom can accordingly be, for example, rotational or translational degrees of freedom, the latter of which can optionally also be non-linear (e.g., when using a slotted guide system).

A controller is also provided by means of which the adjusting unit can be controlled. The adjusting unit is therefore controlled by means of the controller, so that the passenger receptacle driven said adjusting unit is automatically transferred into at least one, preferably a plurality of different predetermined positions during the ride, or experiences a movement, in a controlled or uncontrolled manner. This can be done, for example, at specific times during the ride or at specific points of the track. In the simplest case, this can involve position changes which are carried out and between which a given position is maintained; however, it can also be a complete additional movement of the passenger receptacle during the entire ride, which movement can be described or understood as a sequence of positions or orientations. When moving, the passenger receptacle can perform an uncontrolled and/or unbraked movement and can preferably move freely. Alternatively, the movement can be a controlled movement that gives the passenger the feeling of free and/or uncontrolled movement of the passenger receptacle. The passenger receptacle can also be positioned or oriented during the ride of the amusement ride along the track on the basis of the position on the track.

It is important for the invention that the controller is in signal communication with a memory in which positions, orientations, and/or movement to be assumed during the ride of each passenger receptacle are stored directly or indirectly as memory content, that the controller is designed, by controlling the adjusting unit, to allow the passenger receptacle to assume said positions, orientations, and/or movements in sequence at a given point on the track during the ride, and that the amusement ride has means by which the passenger determines the memory content for the relevant passenger receptacle.

Direct storage of the positions, orientations, and/or movements is understood to mean that the controller reads out the target positions or movements from the memory and determines the control commands necessary to achieve them. The advantage of this approach is that the amount of data that has to be written into or read out from the memory is rather small; however, it increases the demands on the controller, for example with regard to its computing power.

In contrast, indirect storage of the positions, orientations, and/or movements is when the control commands are stored in the memory, so that the controller reads out a program from the memory, the processing of which during the ride on the amusement ride causes the controller to prompt the adjusting unit to cause the corresponding positions, orientations, and/or movements to be assumed. This approach reduces the demands on the (local) controller of the adjusting unit of each passenger receptacle.

The memory can be a local memory of the controller of the adjusting unit of each passenger receptacle, but it can also be a central memory of the amusement ride or a database that is assigned to the controller of each passenger receptacle.

Means by which the passenger determines the memory content for the relevant passenger receptacle, i.e., ultimately the movements, positions, and/or orientations that the passenger receptacle is to assume, allow the passenger to individually influence the movement of the passenger receptacle on which they are riding the ride.

Usually, however, this passenger receptacle is not yet determined at the time the passenger determines the movements, positions, or orientations. The means must therefore not only enable the passenger to make this determination, but also ensure the correct allocation of this content to the correct passenger receptacle.

Accordingly, these means for determining the memory content for the respective passenger receptacle comprise at least one input means by which the passenger can enter the desired movement and/or sequence of positions or orientations and transmission means by which these data can be transmitted or read into a memory.

In a first embodiment of the invention, these transmission means have a receiving means assigned directly to the relevant passenger receptacle, so that a direct transmission takes place from the input means of the passenger to the receiving means of the passenger receptacle.

A specific exemplary embodiment that falls under this embodiment is, for example, that the input means is the passenger's smartphone, on which the passenger has installed a corresponding app. The app shows the course of the track on the display. The passenger marks track sections, for example by touching them with their finger, and selects the position, orientation and/or a movement, i.e., a sequence of movements, positions, and/or orientations to take place on said track section. This can optionally be done at least partially on the basis of a selection or inclusion of suggested positions, orientations, movements, and/or movement patterns, but can also be done as a completely free self creation within the technical possibilities of the passenger receptacle.

Once the selection has been completed, the app can, for example, convert these data into a QR code, which is shown on the display of the smartphone, which simultaneously also serves as a sending means and thus forms part of the transmission means.

When it is the passenger's turn and they are assigned their seat or passenger receptacle in the amusement ride on which said passenger is riding the ride, this QR code is read by a reader which is situated, for example, on the passenger receptacle, and forms the receiving means of the transmission means, is scanned, and the data contained therein is written into the memory of the controller, from which it is then read out and translated into the control commands to be processed for the adjusting unit of the passenger receptacle.

Of course, specific input means which have a display, preferably a touch display and a keyboard, which can also be implemented in the touch display, are also conceivable and are temporarily provided to the passenger. In particular, if this approach is chosen, the data determined or generated by the passenger, for example during the waiting time, can also be transmitted by connecting said input means to the passenger receptacle via a connector when the ride begins. After the ride, the input means are then removed from the passenger receptacle, reset to a defined initial state, and given out again to another passenger.

Wireless transmission of the data selected or generated on the basis of the passenger's selection is also possible.

In a further embodiment of the invention, the memory contents are first transmitted from the receiving means to a central storage means, for example a database in a central control unit of the amusement ride, where they are stored in conjunction with an identification code, which the passenger also receives when completing the selection. For example, when using an app on the passenger's smartphone, a wireless data connection can be established via which these data can be transferred to the database and the identification code can be a bar code or QR code. When the passenger assumes their position on the passenger receptacle, said passenger scans this code with a reader located on the passenger receptacle. The controller assigned to the passenger receptacle then retrieves the data record stored for this identification code from the central storage means of the amusement ride. Particularly if the passenger is provided with a specific input means, identification can also be carried out via an RFID chip.

In the embodiment of the invention in which a transmission is first made to a central storage means of the amusement ride, the input means can also be a stationary part of the amusement ride, for example a terminal past which the passengers in the queue are guided and where they can then program the individual positions, orientations, and/or movements of the passenger receptacle. For the purpose of identification, an RFID tag that initially remains with the passenger or a QR code or bar code that the passenger can photograph with their cell phone can also be used, for example. When the vehicle is entered or when the position in the passenger receptacle is assumed, this identification code is then read out with a reader, and the controller of the passenger receptacle then requests from the central database the memory content assigned to this identification code.

An amusement ride according to the invention is operated using the method according to the invention. Said method is characterized in that, before starting the ride, the passenger selects at least one movement, position, and/or orientation that said passenger's passenger receptacle should assume relative to the vehicle during the passenger's ride on the amusement ride, in that this selection and an identification of the passenger receptacle on which said passenger rides the ride is transmitted to the amusement ride, and in that this selection or control commands corresponding thereto are stored in a memory assigned to the control unit for this passenger receptacle at the latest at the start of the ride.

In a particularly preferred embodiment of this method, before starting the ride the passenger selects at least one movement, position, movement, and/or an orientation that their passenger receptacle should assume relative to the vehicle during the passenger's ride on the amusement ride by means of an app on the passenger's smartphone.

FIG. 1 schematically shows an exemplary sequence of the method for operating an amusement ride. In a first method step 100, at least one passenger can select, before the start of the ride, at least one movement, position, and/or orientation that a passenger receptacle of a vehicle of the amusement ride should assume or perform during the ride.

For example, the passenger can download an app onto their smartphone before visiting the ride and can make a selection in the app for the upcoming ride on the amusement ride. For example, a choice can be made between the following options:

position of the passenger receptacle in the vehicle orientation of the passenger receptacle in relation to the direction of travel of the vehicle, i.e., forward or reverse travel free-spinning, i.e., an uncontrolled and/or unbraked movement, in particular rotational movement, of the passenger receptacle during the ride.

In a second method step 200, an identification of the at least one passenger is transmitted to the amusement ride together with the selection made. As soon as the at least one passenger enters the vehicle of the amusement ride and assumes their position in the passenger receptacle, identification can be carried out in an optional third method step 300, whereby the selection made in the first method step 100 is linked or assigned to the passenger receptacle in question. Identification can be done, for example, using an identification code, bar code, QR code, etc.

For example, the passenger can scan a QR code on the corresponding passenger receptacle with their smartphone or a reader on the passenger receptacle reads an identification code from the smartphone and the controller of the passenger receptacle then requests from the central database the memory content assigned to this identification code.

In a fourth method step 400, the controller retrieves the corresponding data record relating to the selection made and, in method step 500, corresponding control commands are stored in the memory of the control unit for the relevant passenger receptacle. In method step 600, the control commands are executed.

The execution of the control commands in method step 600 can be started immediately after method steps 300 to 500 and before the start of the ride, in particular in the station of the amusement ride. For example, the first control commands can be implemented as soon as the association between the selection made in the first method step 100 and the relevant passenger receptacle has been made and the corresponding data record or data records relating to the selection made has/have been loaded. After the passenger has identified themselves and/or taken a seat in the passenger receptacle, the control commands can be executed immediately, in particular when the vehicle is at a standstill before the ride begins. In this case the vehicle is preferably located in the station of the amusement ride.

In the simplest case, the passenger receptacle can be connected to the vehicle via a rotational joint. The rotational joint can have a coupling which can be actuated by the control unit by means of an adjusting unit and/or a bolt which can be actuated by the control unit by means of an adjusting unit and which can lock the rotational joint. The passenger receptacle can therefore either be fixed or freely rotatable, as a result of which the passenger receptacle can preferably perform a free rotational movement during the ride.

The adjusting unit can be, for example, an actuator, a drive, and/or a brake.

Furthermore, the adjusting unit can be designed to change the position and/or the orientation in relation to the passenger receptacle in at least one degree of freedom. For example, the orientation of the passenger receptacle can be adjusted to "backward" or "forward", or the previously described rotational movement can be damped, braked, or even increased by the adjusting unit, or a movement pattern can be created.

The invention claimed is:

1. An amusement ride comprising:

at least one vehicle which is guided along a track;

at least one passenger receptacle for accommodating a passenger being situated on the at least one vehicle;

at least one adjusting unit in at least one degree of freedom for changing a movement, a position and/or an orientation of the at least one passenger receptacle relative to the at least one vehicle;

a controller for controlling the at least one adjusting unit, wherein the controller is in signal communication with a memory in which movements to be performed, positions to be assumed, and/or orientations to be assumed before a start of a ride or during the ride of the at least one passenger receptacle are stored directly or indirectly as memory content, the controller being configured to allow said positions, orientations, and/or movements to be assumed in sequence at a given point on the track before the start of the ride or during the ride, and wherein the amusement ride further comprises means for determining the memory content for the at least one passenger receptacle, wherein the controller is further configured to:

receive input from a passenger, before the start of the ride, the input representing at least one selected movement, position and/or orientation of the at least one passenger receptacle relative to the at least one vehicle;

store the at least one selected movement, position and/or orientation in the memory no later than at a start of a ride; and during the ride, automatically execute a stored sequence including the at least one selected movement, position and/or orientation, in order, at predetermined points along the track using the at least one adjusting unit.

2. A method for operating the amusement ride according to claim 1, comprising:

before starting the ride, the passenger selects at least one movement, position, and/or orientation that the at least one passenger receptacle corresponding to the passenger should assume or perform relative to the at least one vehicle before the start of the ride or during the passenger's ride on the amusement ride;

transmitting the selection of the passenger and an identification of the at least one passenger receptacle on which the passenger rides to the amusement ride, the selection or control commands corresponding thereto being stored in the memory of the controller before the start of the ride or, at the latest, at the start of the ride; and during the ride, automatically executing a stored sequence including the at least one selected movement, position and/or orientation, in order, at predetermined points along the track, using the at least one adjusting unit.

* * * * *